US010571096B2

(12) United States Patent
Rodriguez et al.

(10) Patent No.: US 10,571,096 B2
(45) Date of Patent: Feb. 25, 2020

(54) LIGHT FIXTURE WITH ACCESSIBLE ELECTRONICS HOUSING

(71) Applicant: ABL IP Holding LLC, Atlanta, GA (US)

(72) Inventors: Eric O. Rodriguez, Smyrna, GA (US); Brad Carney, Fayetteville, GA (US); LaDarius Agee, Atlanta, GA (US); Rick Martin Kelly, Loganville, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/145,330

(22) Filed: Sep. 28, 2018

(65) Prior Publication Data

US 2019/0249849 A1 Aug. 15, 2019

Related U.S. Application Data

(60) Provisional application No. 62/630,980, filed on Feb. 15, 2018.

(51) Int. Cl.

| | |
|---|---|
| ***F21V 15/01*** | (2006.01) |
| ***F21V 19/04*** | (2006.01) |
| ***F21S 8/06*** | (2006.01) |
| ***F21V 23/00*** | (2015.01) |
| ***F21V 11/14*** | (2006.01) |
| ***F21V 29/76*** | (2015.01) |

(Continued)

(52) U.S. Cl.

CPC ..... *F21V 15/012* (2013.01); *F21S 8/061* (2013.01); *F21V 11/14* (2013.01); *F21V 19/04* (2013.01); *F21V 23/009* (2013.01); *F21V 29/763* (2015.01); *F21V 31/005* (2013.01); *F21Y 2115/10* (2016.08)

(58) Field of Classification Search

CPC .... F21V 15/012; F21V 31/005; F21V 29/763; F21V 11/14; F21V 19/04; F21V 23/009; F21S 8/061; F21Y 2115/10

See application file for complete search history.

(56) References Cited

U.S. PATENT DOCUMENTS

| | | |
|---|---|---|
| 4,261,030 A | 4/1981 | Hernandez |
| 4,692,844 A | 9/1987 | Galerne |

(Continued)

FOREIGN PATENT DOCUMENTS

| | | |
|---|---|---|
| EP | 1512811 | 3/2005 |
| EP | 2503232 | 9/2012 |

*Primary Examiner* — Donald L Raleigh

(74) *Attorney, Agent, or Firm* — Kilpatrick Townsend & Stockton LLP

(57) ABSTRACT

A light fixture includes a light engine comprising at least one light emitting diode (LED), the light engine comprising a front surface and a rear surface. The element includes an electronics housing that is configured to house a plurality of electronic components. The electronics housing is coupled at a first end with the rear surface of the light engine. The electronics housing further includes a second end and at least one side wall extending between the first end and the second end. The at least one side wall defines an aperture though which at least some of the plurality of electronic components are accessible. The light fixture also includes a cover that is coupled with the at least one side wall, the cover being sized and shaped to cover the aperture.

18 Claims, 13 Drawing Sheets

(51) Int. Cl.
*F21V 31/00* (2006.01)
*F21Y 115/10* (2016.01)

(56) References Cited

U.S. PATENT DOCUMENTS

| | | | | |
|---|---|---|---|---|
| 4,800,475 | A | 1/1989 | Panagiotou | |
| 4,992,918 | A | 2/1991 | Shioiri et al. | |
| 5,243,508 | A | 9/1993 | Ewing et al. | |
| 5,329,436 | A * | 7/1994 | Chiu | F21V 29/004 165/185 |
| 5,553,730 | A | 9/1996 | Kohnen | |
| 5,800,041 | A | 9/1998 | Poggi | |
| 5,906,287 | A | 5/1999 | Kohnen | |
| 6,337,792 | B1 | 1/2002 | George | |
| 6,585,389 | B2 | 7/2003 | Bonazzi | |
| 7,322,720 | B1 | 1/2008 | Haddad | |
| 7,726,849 | B2 | 6/2010 | Haddad et al. | |
| 8,360,620 | B1 | 1/2013 | Rashidi | |
| 8,465,181 | B2 | 6/2013 | Burt | |
| 2013/0027935 | A1 * | 1/2013 | Ladewig | F21S 2/00 362/249.01 |
| 2015/0267910 | A1 | 9/2015 | Lazalier | |
| 2016/0053982 | A1 * | 2/2016 | Kovalchick | F21V 23/009 362/238 |
| 2017/0038022 | A1 * | 2/2017 | Shikata | F21S 41/143 |
| 2018/0156441 | A1 * | 6/2018 | Wang | F21V 29/51 |

* cited by examiner

LIGHT FIXTURE WITH ACCESSIBLE ELECTRONICS HOUSING

CROSS-REFERENCES TO RELATED APPLICATIONS

This application claims the benefit of U.S. Provisional Application No. 62/630,980, entitled "LIGHT FIXTURE WITH ACCESSIBLE ELECTRONICS HOUSING", filed on Feb. 15, 2018, the entire contents of which are hereby incorporated by reference.

BACKGROUND OF THE INVENTION

Light fixtures for light emitting diodes (LEDs) include an electronics housing that contains electrical components of the light fixture. Typical designs do not provide easy access to the electrical components contained within the housing. As a result, when a particular electrical component needs to be serviced or replaced, conventional light fixtures must be disconnected and oftentimes at least partially disassembled in order to access the desired component. This may involve removing a number of brackets and fasteners in order to remove the fixture from its installation site and to open the housing to gain access into the interior of the housing. This process can be very time consuming and oftentimes makes it more cost effective simply to replace the entire light fixture, rather than to service or replace a single electrical component.

BRIEF SUMMARY OF THE INVENTION

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Embodiments of the present invention provide light fixtures having electronics housings that provide access to interior electrical components of the light fixture while the fixture is still in an installed and assembled state. Such electronics housings include sidewalls that define at least one aperture that provide access to the electrical components, allowing individual electrical components to be serviced and/or replaced quickly and thereby eliminating the need to disassemble the light fixture. This saves considerable time and prevents the wasting of light fixtures that only have a small number of malfunctioning or otherwise unusable components. A removable cover is provided that can cover and seal the aperture such that the interior components of the light fixture remain protected when the light fixture is not being serviced.

In one embodiment, a light fixture is provided. The light fixture may include a light engine having at least one light emitting diode (LED). The light engine may include a front surface and a rear surface. The light fixture may also include an electronics housing configured to house a plurality of electronic components. The electronics housing may be coupled at a first end with the rear surface of the light engine. The electronics housing may further include a second end and at least one side wall extending between the first end and the second end. The at least one side wall may define an aperture though which at least some of the plurality of electronic components are accessible. The light fixture may also include a cover that is coupled with the at least one side wall, the cover being sized and shaped to cover the aperture.

In another embodiment, a light fixture includes a light engine having at least one LED. The light engine may include a front surface and a rear surface. The light fixture may also include an electronics housing configured to house a plurality of electronic components. The electronics housing may be coupled at a first end with the rear surface of the light engine. The electronics housing may further include a second end and a sidewall having a generally circular cross-section. The sidewall may extend between the first end and the second end. The sidewall may define an aperture through which at least some of the plurality of electronic components are accessible. The light fixture may also include a cover that is detachably coupled with the side wall. The cover may be sized and shaped to cover the aperture. The light fixture may further include a gasket positioned between edges of the cover and the electronics housing. The gasket may be configured to seal the electronics housing when the cover is positioned over the aperture. The light fixture may include a plurality of fasteners configured to secure the cover to the electronics housing.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the invention relate to light fixtures having an associated electronics housing, whereby the components housed within the electronics housing are easily accessible when the light fixture is in situ. For example, the electronics housing 104 may have one or more apertures formed in at least one sidewall that provides access to an interior of the electronics housing. A removable access cover or door may be provided to seal the aperture when access to the interior of the electronics housing is not necessary. In some embodiments, the light fixture may include any or all of the features and components of the light fixtures disclosed in US 2016/0290603, the entirety of which is herein incorporated by reference. Another exemplary embodiment of the light fixture is shown in the attached drawings and includes a light engine with an associated electronics housing extending upwardly from the light engine. The light fixture shown in the figures is for illustrative purposes only. The light fixture components may have any shape, size, and configuration, and embodiments are certainly not limited to the specific embodiments disclosed in the figures.

Figure 1:
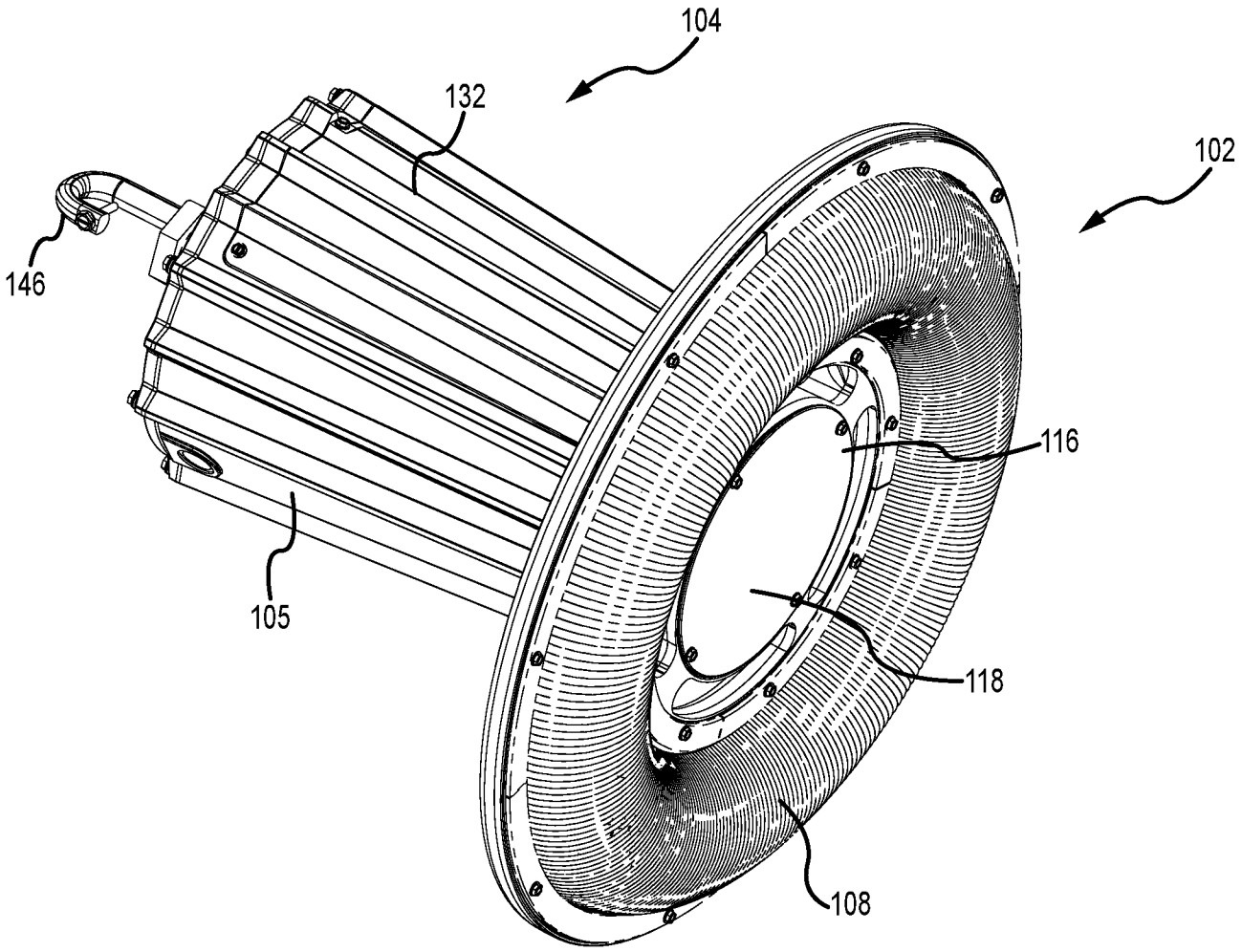
FIG. 1 is a bottom isometric view of an embodiment of a light fixture.
Figure 2:
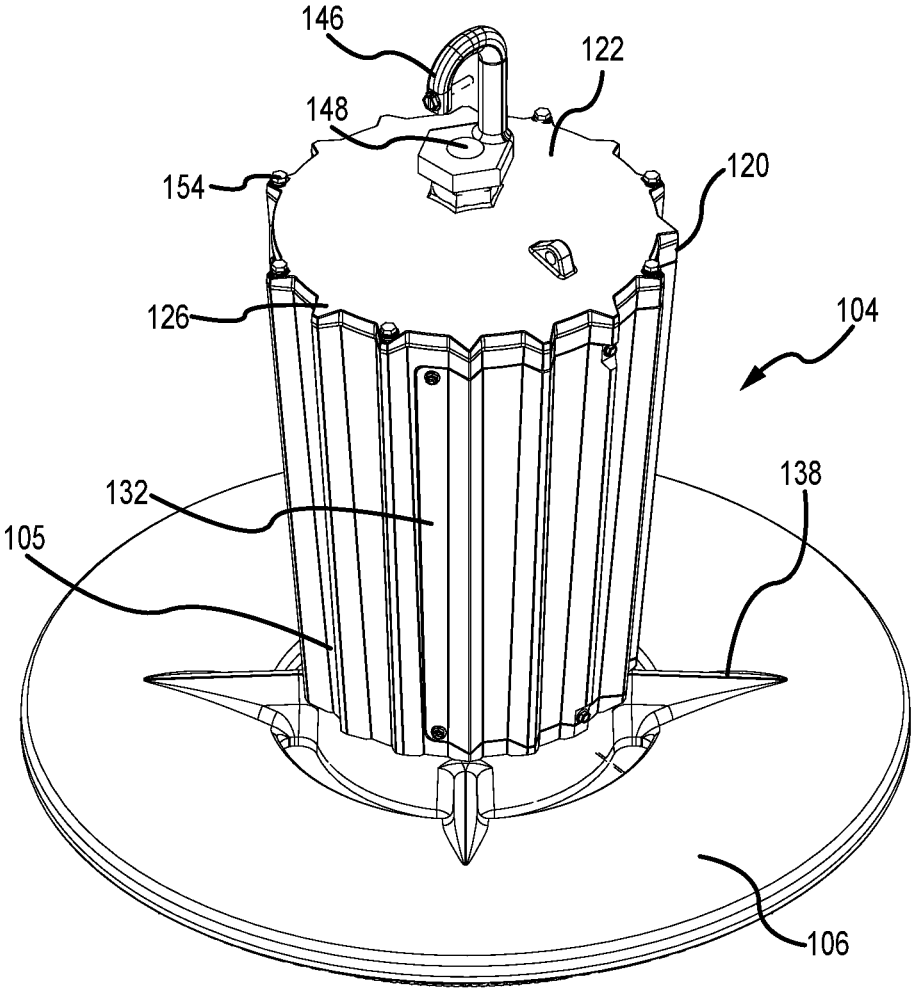
FIG. 2 is a top isometric view of the light fixture of FIG. 1.
Figure 3:
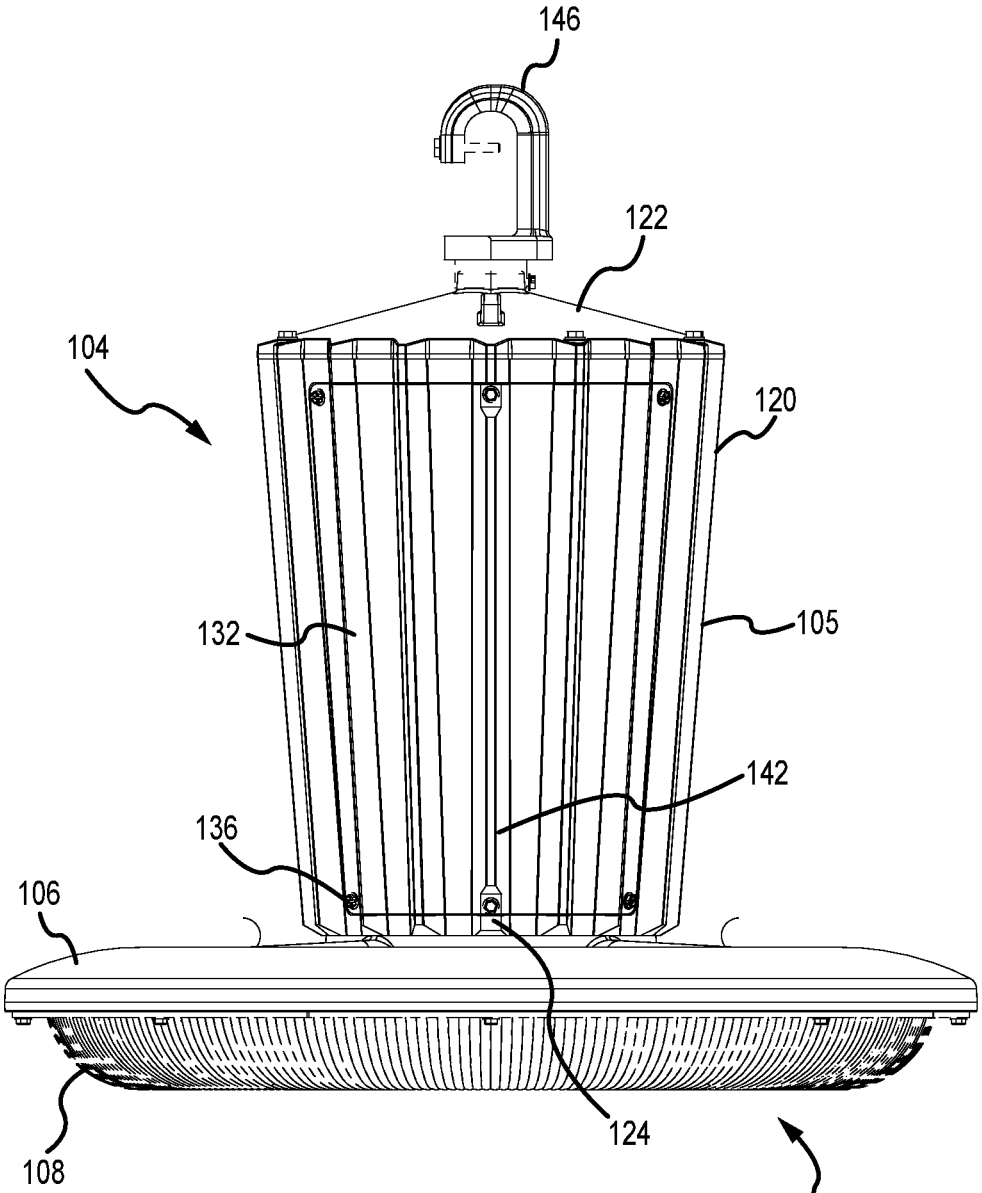
FIG. 3 is a side elevation view of a light fixture of FIG. 1.

Turning now to FIGS. 1-3, one embodiment of a light fixture 100 is shown. The light fixture 100 may include a light engine 102 and an electronics housing 104. The light engine 102 may include a back housing 106 and an outer optic 108 that is secured to the back housing 106 and that defines a front surface of the light engine 102.

The outer optic 108 may couple with back housing 106 to form watertight seals, or may be simply held in place without sealing. For example, as depicted in the exploded view of light engine 102 illustrated in FIG. 4, gaskets 112 formed of silicone or rubber may be utilized where the inner edges and the outer edges of the back housing 106 and outer optic 108 meet in order to form seals therebetween. The outer optic 108 may be affixed or otherwise secured to the back housing 106 in any way, including with adhesives, mechanical fasteners (e.g., screws, self-tapping screws, bolts, pins, rivets, or any other mechanical fastening device), and/or using other attachment techniques. One or more compression rings 156 may be positioned against an exterior surface of the outer optic 108 and fastened to the outer optic 108 and the back housing 106 to secure the components together.

Figure 4:
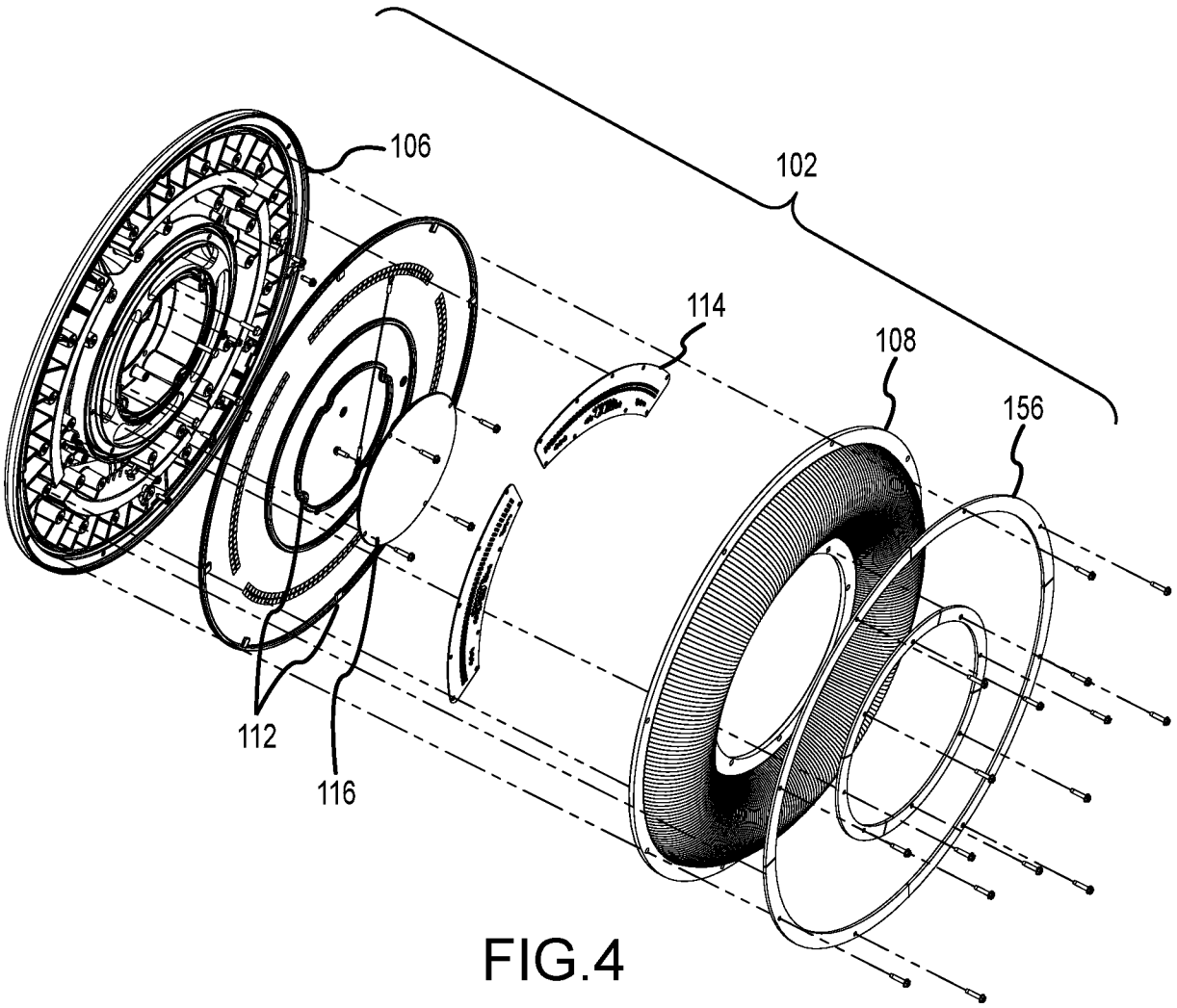
FIG. 4 is an exploded view of a light engine of the light fixture of FIG. 1.

As seen in FIG. 4, the light engine 102 includes at least one light source for emitting light from the light engine 102 through the outer optic 108. In some embodiments, the light source is LEDs mounted on a printed circuit board ("PCB") 114. The PCB 114 can be attached to the back housing 106 in some embodiments. Each PCB 114 can have wiring for connecting to a power supply, which can be shared between PCBs 114 or each PCB 114 could have its own power supply. The LEDs may be single-die or multi-die LEDs, DC or AC, or can be organic light emitting diodes. White, color, or multicolor LEDs may be used. Moreover, the LEDs mounted on a PCB 114 need not all be the same color; rather, mixtures of LEDs may be used. Furthermore, in some embodiments no PCB is needed; rather, the LEDs are chip-on-board LEDs provided directly on the back housing 106 or other structure within the light engine 102.

The back housing 106 may be formed of suitable metallic or polymeric material, but in some embodiments it is formed from a thermally conductive material so as to help dissipate the heat generated by the LEDs. For example, in some embodiments the back housing 106 is formed from metal (such as aluminum or steel) to promote heat dissipation from the LEDs and may be formed by casting. In some embodiments, heat dissipation fins may be provided on the exposed outer surface of the back housing. However, in other embodiments, that surface is rounded and smooth so as to comply with National Sanitation Foundation (NSF) requirements for light fixtures used in the food processing industry.

The optic 108 may serve both as an aesthetic cover and to functionally direct or diffuse light from the light engine 102. The optic 108 may be formed of glass or plastic (e.g., acrylic, polycarbonate, silicone, etc.), typically but not necessarily by molding. In some embodiments, the outer optic 108 is configured with optical enhancements to achieve a desired light distribution and effect from the light fixture 100. The outer optic 108 may be of any type (diffuse, prismatic, etc.) that achieves the desired light emission from the fixture 100. While a curved optic 108 is shown, the optic 108 may have any geometry and may be provided with any surface enhancements or no surface enhancements.

Other features, including additional optics, reflectors, gaskets, etc. may be provided within the light engine 102 to further direct the light as desired and seal the various components together.

Figure 5:
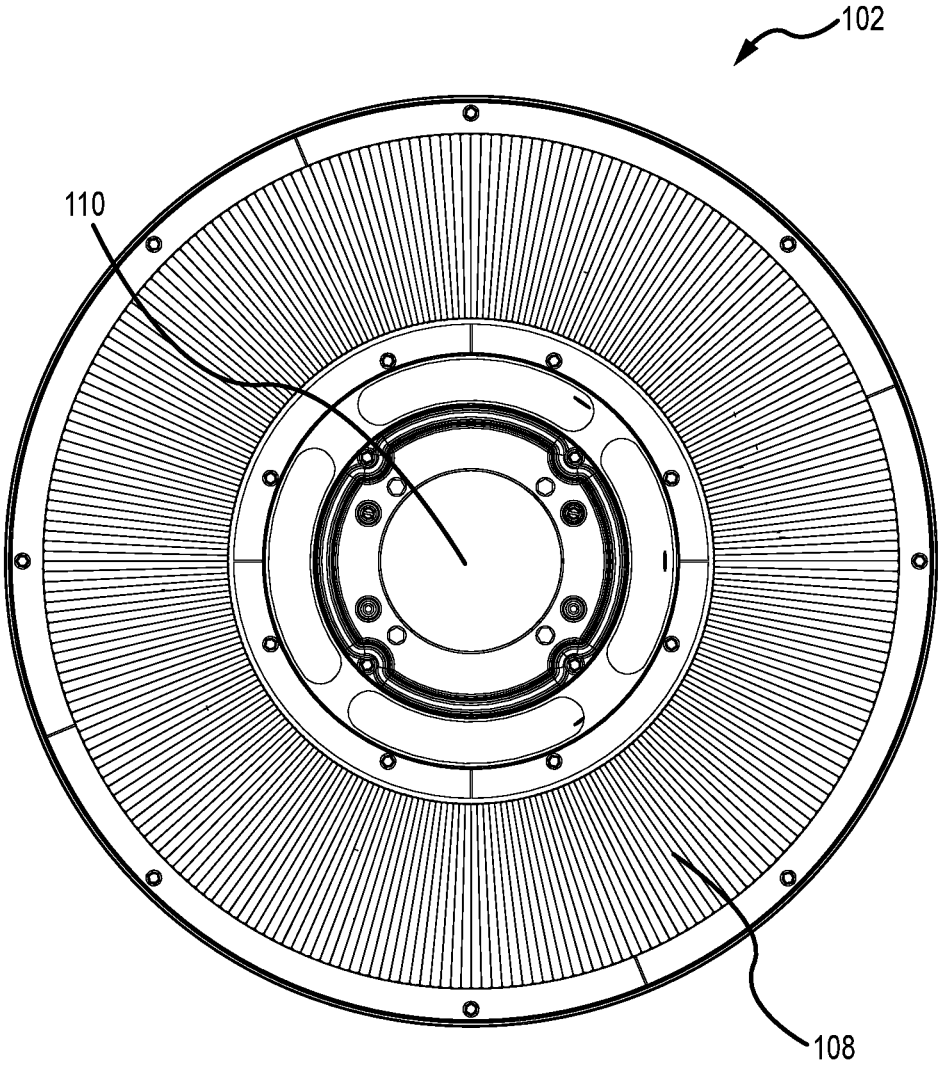
FIG. 5 is a bottom plan view of the light engine of FIG. 4.
Figure 9:
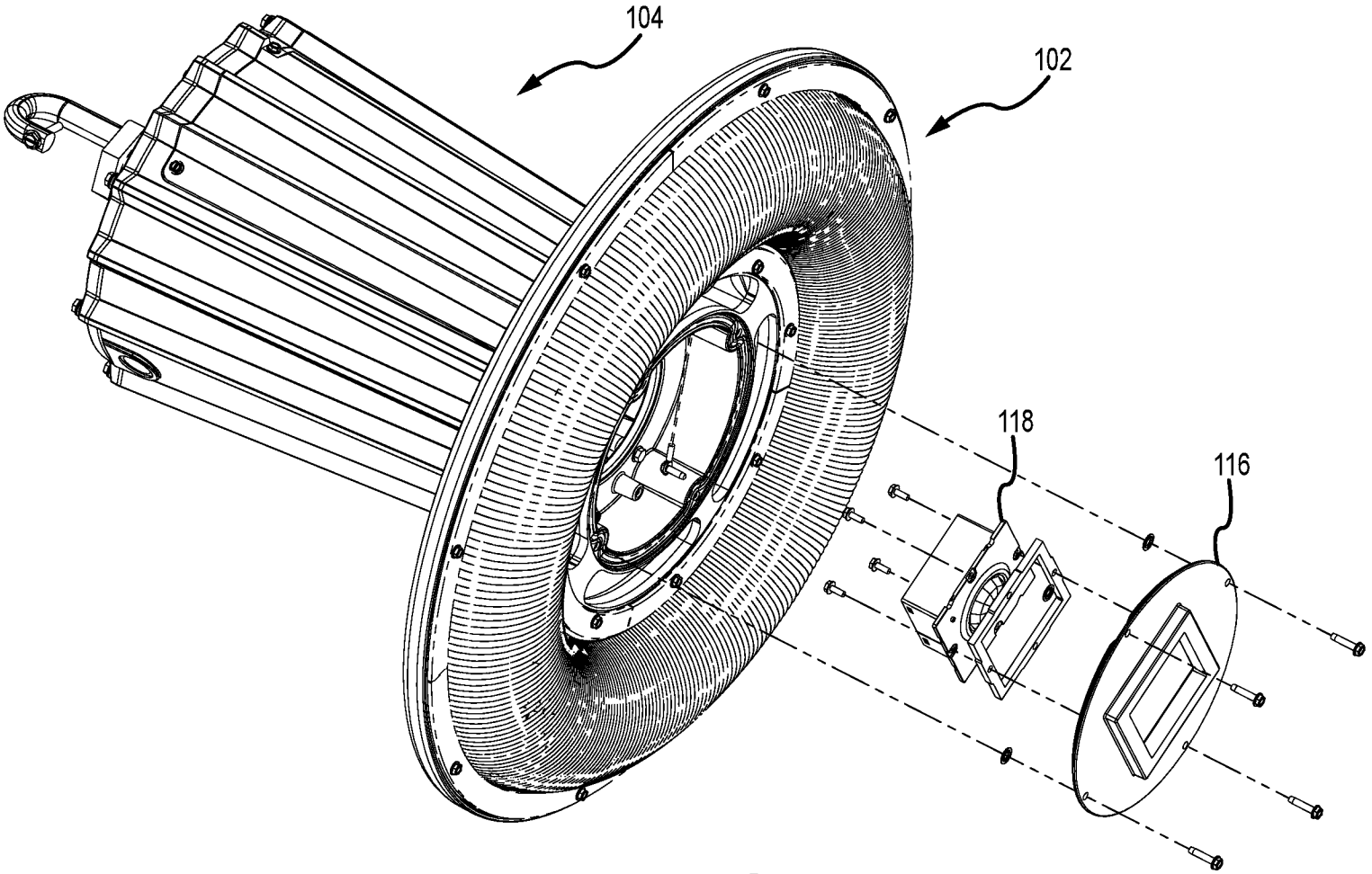
FIG. 9 is a partially exploded view of another embodiment of a light fixture.
Figure 10:
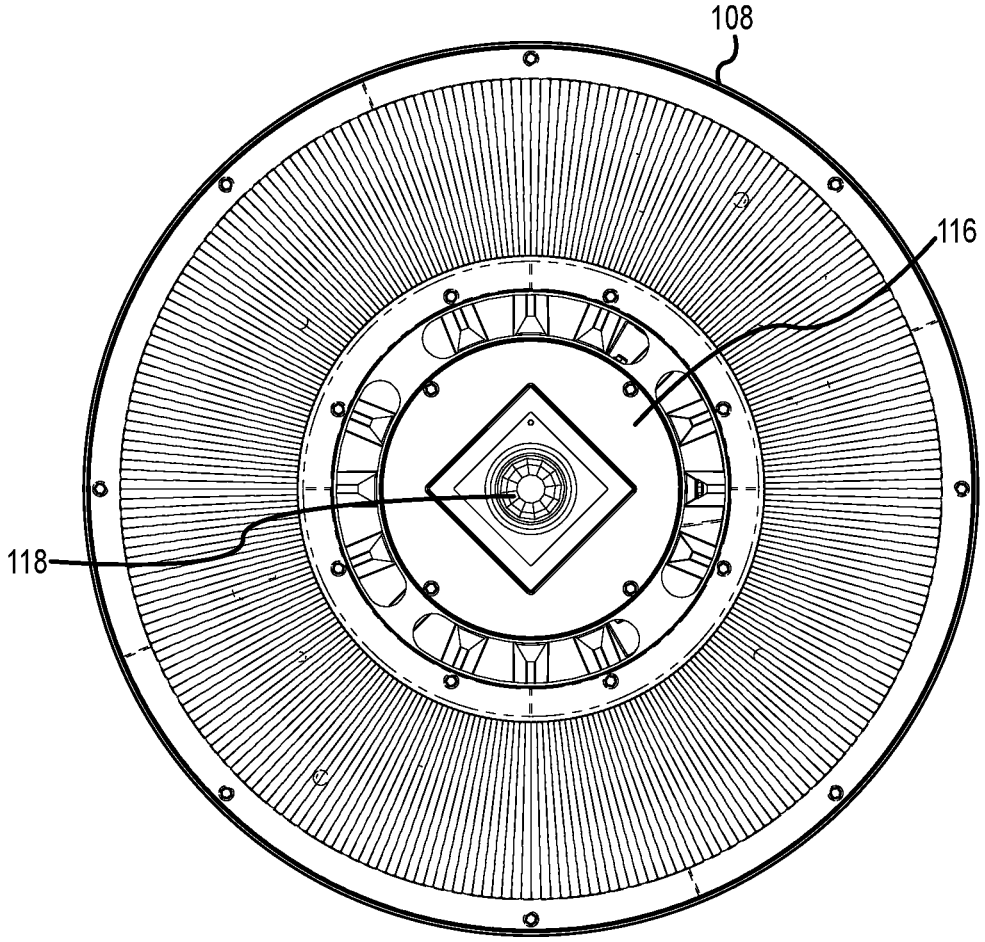
FIG. 10 is a bottom plan view of the light fixture of FIG. 9.

In the illustrated embodiment, the back housing 106 and outer optic 108 form a generally toroidal (i.e., donut) shape such that a central cavity 110 is formed within the light engine 102 (see FIG. 5); however, other light fixtures may have light engines of other shapes. A cover plate 116 may be positioned to enclose the central cavity 110 (see FIG. 4). As shown in FIGS. 9 and 10, the central cavity 110 may be used to house light fixture accessories 118, such as, but not limited to: Bluetooth speakers and/or sensors, (e.g., motion, light, etc.), wireless communications sensors that may be used to provide control of the light engine 102 using a wireless device such as a wireless switch and/or mobile device, and/or other accessories. In some embodiments, the cover plate 116 is designed to cover and/or seal the central cavity 110 of the light fixture 100 and thereby protect the light fixture accessories 118 stored therein. For example, one or more gaskets (not shown) may be positioned between the cover plate 116 and the light engine 102. In some embodiments, the accessory 118 may be entirely covered by the cover plate 116 such that the accessory 118 is sealed from the environment. One or more windows may be provided in the cover plate 116 to ensure line of sight. The cover plate 116 is preferably, but not necessarily, removable to permit access to the central cavity 110 and any light fixture accessories 118 housed therein.

FIGS. 5-8 illustrate components of electronics housing 104. The electronics housing 104 generally includes a body 105, a top cover 122, and an access door 132 that, when coupled together, form an inner compartment for housing some or all of the electrical components of light fixture 100. For example, the electronics housing 104 may house electronics (e.g. drivers, etc.) for appropriately driving the LEDs (e.g., in some cases, converting external power to the low voltage DC power used by some LEDs).

The body 105 is typically made of metal formed by casting or extruding, although other materials can be utilized, and certain portions of electronics housing 104 may be made of metal while other portions are made of other materials, such as insulators like plastics or rubbers. The body 105 may be of any geometrical shape, including, but not limited to, rectilinear or circular in cross-section. The body 105 can be, but need not be, of a consistent width or diameter. Rather, in some embodiments, the body 105 tapers along its height, either upwardly or downwardly. In the illustrated embodiment, the body 105 has a generally circular cross-section and extends upwardly from the light engine 102, however other cross-sectional shapes are possible. In some embodiments, the body 105 may have a constant cross-section, while in other embodiments, such as shown here, it may have a tapered cross-section. As illustrated here, the body 105 has a conical frustum shaped cross-section that tapers outward as the body 105 extends away from the light engine 102. The electronics housing 104 is positioned behind the central cavity 110 of the light engine 102 and attached to the back housing 106, such as by using screws or other fasteners. In one embodiment, the body 105 of the electronics housing 104 is attached by securing screws into bosses (not shown) provided on the back housing 106. One or more heat dissipation fins 138 may extend between a rear surface of the back housing 106 and the electronics housing 104 and may help dissipate heat from the light engine 102. Fins 138 may also additional structural support to the connection between the light engine 102 and the electronics housing 104.

In the illustrated embodiment, the body 105 of the electronics housing is formed of a sidewall 120 having a generally circular cross-section and that defines an interior of the electronics housing 104, although it will be appreciated that other number and/or shapes of sidewalls may be used. For example, oval, rectangular, triangular and/or other electronics housing body shapes may be contemplated. Sidewall(s) 120 may include one or more ribs or fins 124 that extend along an outer surface of the body 105 in a longitudinal and/or lateral direction. The fins 124 may improve heat dissipation from the electronics housing 104. Such fins may not be provided in all cases. The fins 124 may also provide additional strength and thickness to the electronics housing 104, as well as provide a texture that makes the lighting fixture 100 easier to grip. In some embodiments, the fins 124 may be hollow, with the material forming each fin 124 having a thickness that is the same or similar to a thickness of the remainder of the one or more sidewalls 120. In some embodiments, the fins 124 may be solid. In such embodiments, a topmost surface of one or more of the fins 124 may provide a coupling site to secure the top cover 122 to the body 105. For example, the top cover 122 may be circular and may include one or more protrusions 126 that are generally sized and shaped to match the fins 124 extending outwardly from the body 105. Fasteners 154, such as screws or rivets, may be inserted through apertures in one or more of the protrusions 126 and into one or more of the fins 124 to secure the top cover 122 to the body 105.

At least one wiring aperture 148 is provided in the top cover 122 through which at least one power line (e.g., a 120V AC line) is fed for powering the light fixture 100. The wire may extend through the top cover 122 and into the interior of the electronics housing 104 and/or to the light engine 102 for powering the various components of the light fixture 100.

Figure 7B:
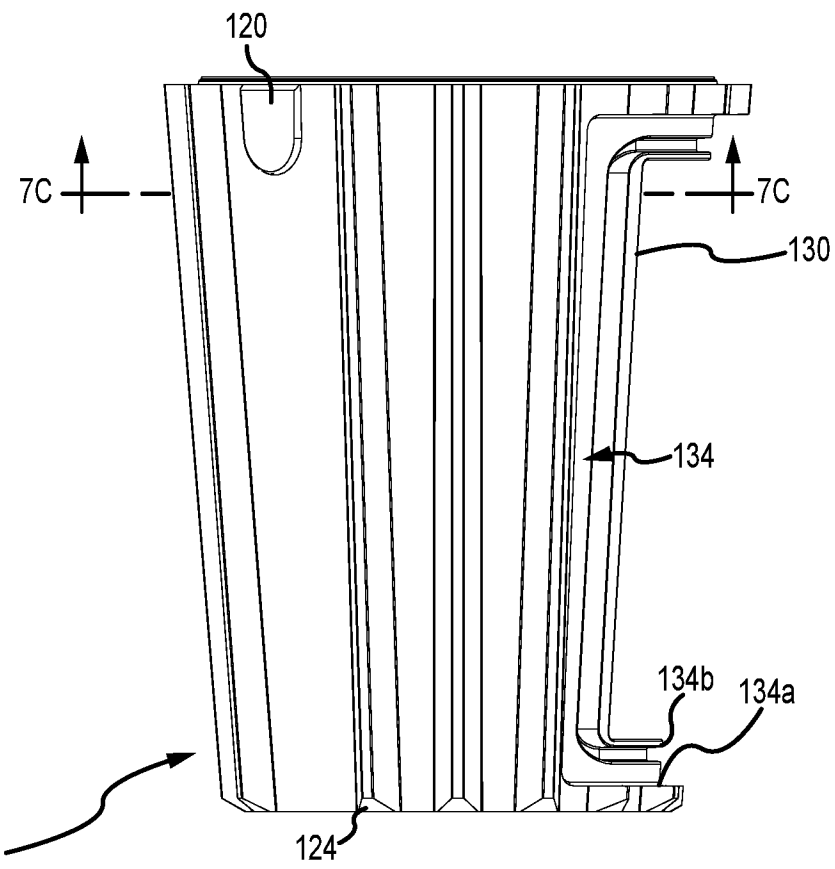
FIG. 7B is a side view of the electronics housing of FIG. 7A.
Figure 7A:
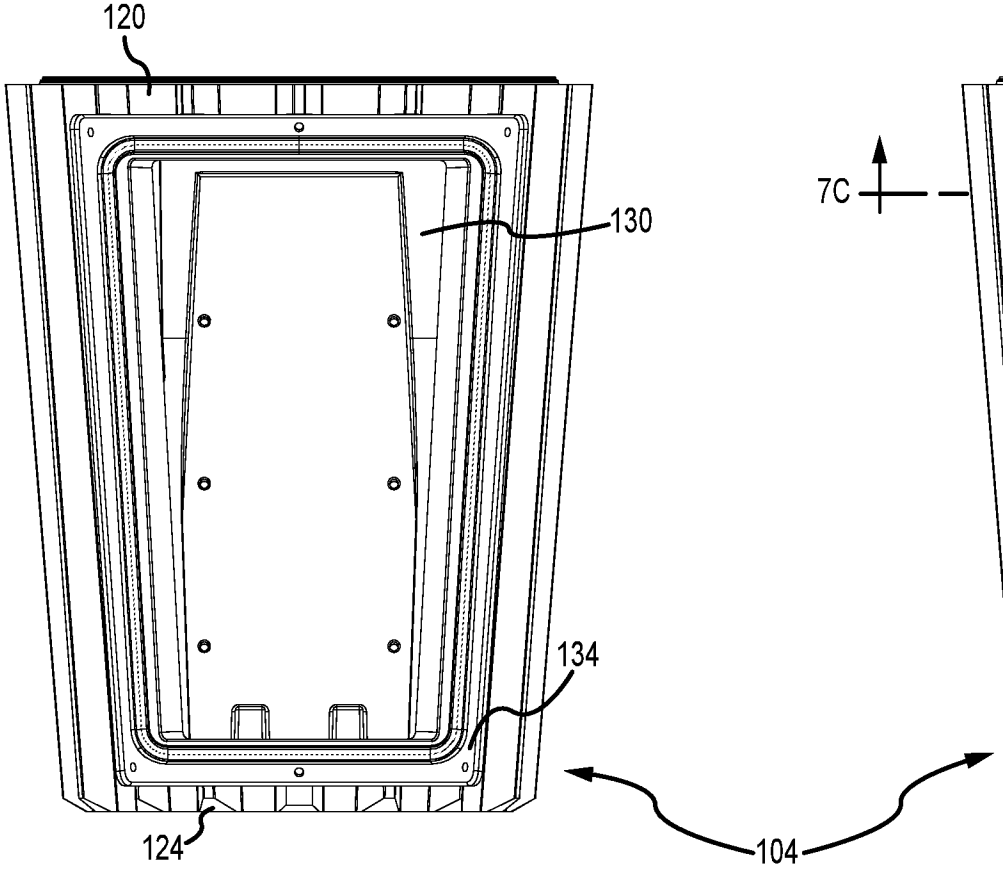
FIG. 7A is a front view of the electronics housing of FIG. 6 without the access door.
Figure 7C:
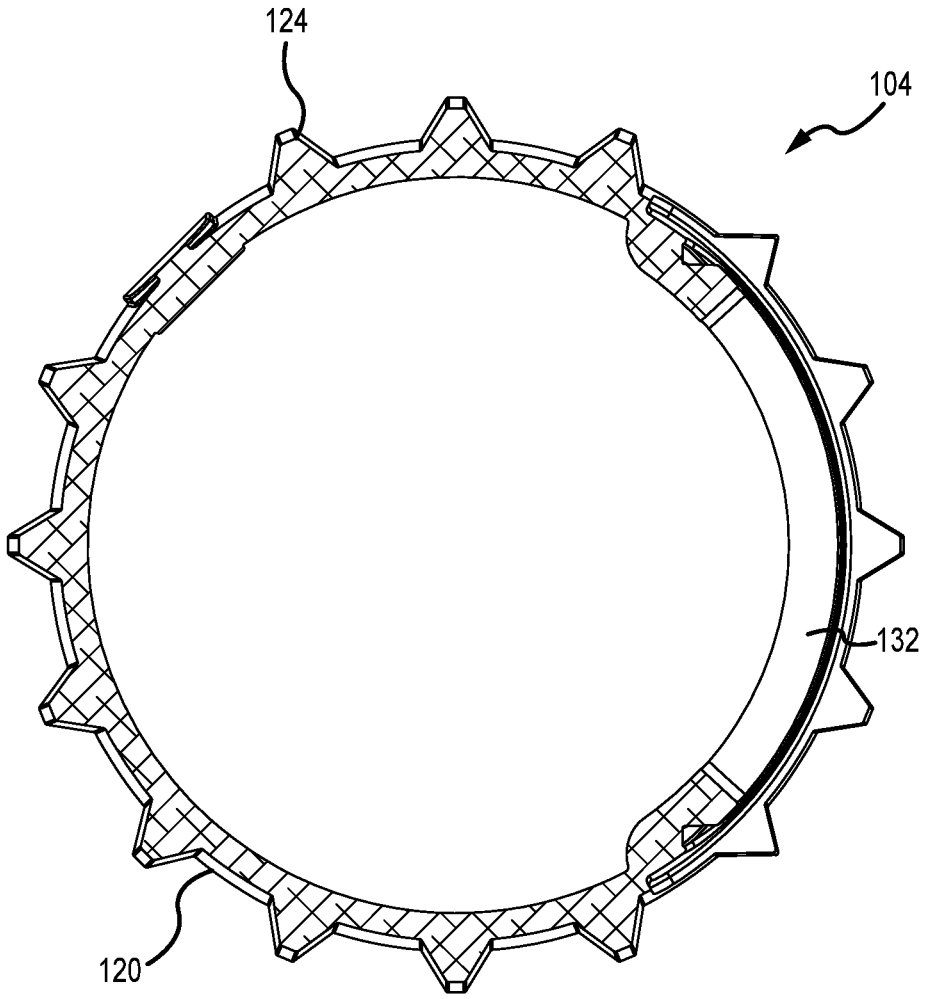
FIG. 7C is a cross-sectional view of the electronics housing of FIG. 7B taken along line 7C-7C.

As illustrated in FIGS. 7A-7C, an aperture 130 is provided in the sidewall 120 of the body 105. The aperture 130 provides access to the various components within the electronics housing 104, such as for servicing, replacement, and/or maintenance of same. The aperture 130 can be of any size and shape, but should be of a size that permits easy ingress and egress of electrical components into and out of the electronics housing 104. The aperture 130 may be positioned relative to the one or more sidewalls 120 based on the location of various components, especially of those components that are deemed to have the highest likelihood of failure and/or the highest benefit associated with replacement or service. Typically, the aperture 130 is offset from a top and bottom of the body 105 such that at least a portion of the sidewall(s) 120 wraps continuously around the body 105. Such a design prevents the electronics housing 104 from deforming and strengthens the electronics housing 104 against impact forces. Additionally, such a design makes it easier to seal the aperture 130, as the interface between only two surfaces (the portion of the sidewall 120 defining aperture 130 and edges of an access cover or door) needs to be sealed.

In some embodiments, an outer periphery of the aperture 130 may be defined by an indented portion 134. Indented portion 134 may extend around all or a part of the outer periphery of the aperture 130. The indented portion may provide a seat for mounting an access door to the electronics housing to cover and seal the aperture 130. In some embodiments, the indented portion 134 may include different depths. For example, in the illustrated embodiment, the indented portion 134 includes an outer section 134*a* having a shallower depth that is designed to match the thickness of an outer edge of an access door, while an inner section 134*b* of the indented portion 134 may have a greater depth that may be sized to accommodate a sealing mechanism, such as a gasket 140, that may be compressed between the access door and the body 105. In some embodiments, the indented portion 134 may define one or more threaded receptacles for receiving fasteners to secure an access door to the body 105.

Figure 8A:
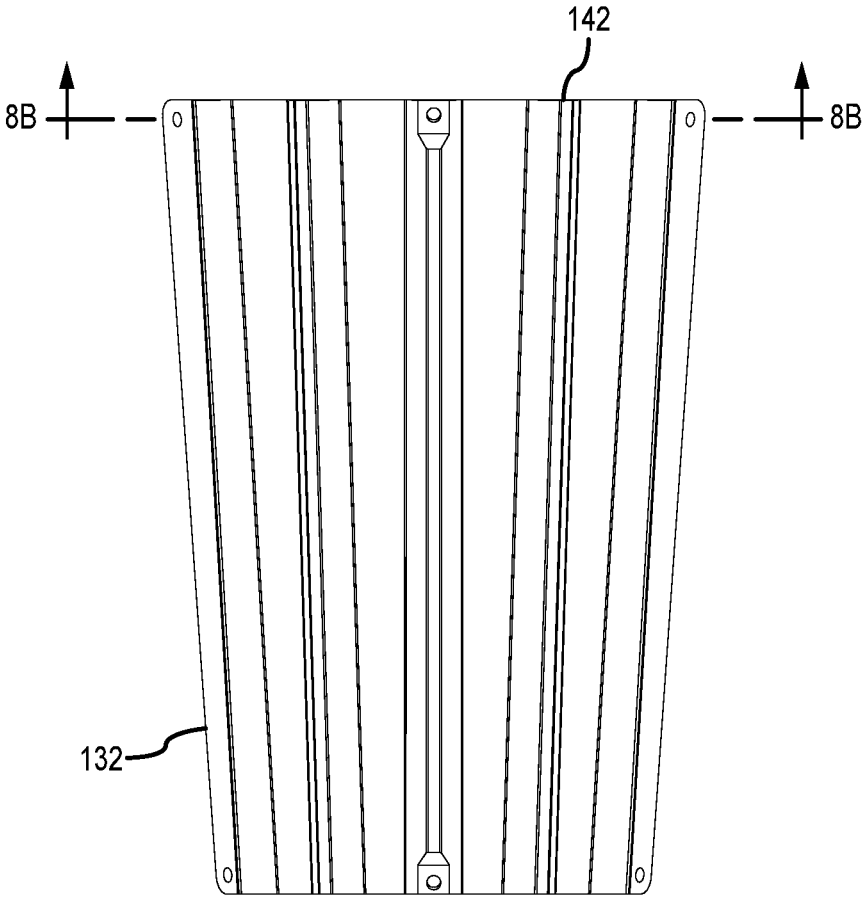
FIG. 8A is a front view of the access door of the electronics housing of FIG. 6.
Figure 8B:
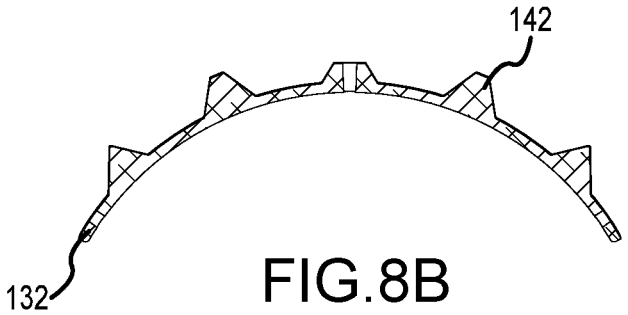
FIG. 8B is a cross-sectional view of the access door of FIG. 8A taken along line 8B-8B.

Electronics housing 104 also includes one more access doors 132, as shown in FIGS. 8A and 8B, that may be used to cover and seal the aperture 130. The access door 132 may be made of the same or different materials as the body 105. The access door 132 can be, but does not have to be, of a size to cover the aperture 130 and of a shape similar to that of the sidewall 120 of the body 105 so that, when secured to the body 105, a virtually seamless transition is created between the body 105 and the access door 132 to impart a polished appearance to the electronics housing 104. By way only of example, in the illustrated embodiment the sidewall 120 is curved in shape and the access door 132 is also curved and has the same or similar radius of curvature. The access door 132 may be secured to the body 105 in any way, including with mechanical fasteners (e.g., screws, self-tapping screws, bolts, pins, rivets, or any other mechanical fastening device).

In the illustrated embodiment, access door 132 is secured to the sidewall 120 and over the aperture 130 using one or more fasteners 136, such as screws, as shown in FIG. 3. The fasteners 136 may be inserted through the access door 132 at one or more positions along the outer periphery of the access door 132. In embodiments in which access door 132 includes one or more flanges, the fasteners 136 may be inserted through the flange(s). The fasteners 136 may also be inserted though the sidewall(s) 120 at positions proximate to aperture 130. For example, in embodiments having an indented portion 134, the fasteners 136 may be inserted through the indented portion 134. As just one example, an access door 132 may include at least one fastener at each vertex or corner of the access door 132, although it will be appreciated that other arrangements of fasteners may be contemplated. For example, in the illustrated embodiment a fastener 136 is positioned at a medial portion (oftentimes in alignment with a central axis of the access door 132) of each of the top and bottom of the outer periphery of the access door 132. Such positioning may be particularly advantageous in embodiments in which the access door 132 has a curved cross-sectional profile. Due to the thickness of the uncompressed gasket 140, the fasteners 136 at the corners and/or the sides of the access door 132 may be misaligned with corresponding apertures in the one or more sidewall(s) 120. When replacing the access door 132 over the aperture 130, the fasteners 136 at the medial portions of the outer periphery may be tightened prior to tightening the fasteners 136 at the corners of the access door 132. By tightening the medial fasteners 136 first, the gasket 140 may be compressed, allowing the fasteners 136 at corners and/or sides of the access door 132 to be properly aligned with corresponding apertures formed in the sidewall(s) 120. In some embodiments, the fasteners 136 may be inserted through the access door 132 at flat positions that extend between each of the fins 142 to provide a generally flat surface through which the fasteners 136 may be inserted. In other embodiments, a portion of one or more of the fins 142 may be flattened portions to provide similar insertion points. In some embodiments, a combination of flattened fins 142 and flat portions extending between the fins 142 may be provided for fasteners 136.

Access door 132 can also include fins 142 that match a size and arrangement of fins 124 on the body 105 such that, when the access door 132 is interfaced with the body 105, the fins 142 of the access door 132 and the fins 124 of the body 105 are in alignment to contribute to the seamless appearance. As illustrated in FIG. 8A, a portion of one or more of the fins 142 may be flattened to provide a surface for inserting a fastener though the access door 132 to secure the access door 132 to the body 105. In some embodiments, an entire fin 142 may be flattened, while in other embodiments only a portion of the fin 142 near the fastener is flattened.

In some embodiments, the access door 132 may include one or more flanges (not shown) that extend around all or a part of the outer periphery of the access door 132. The flange may form a thinner portion of the access door 132, such that a rear side of the flange is offset relative to a main body of the access door 132. The flange may be sized and shaped to correspond to the indented portion 134 formed on the electronics housing 104. For example, the indented portion 134 may extend around all or part of the aperture 130 and provide a site for the flange of the access door 132 to seat against the electronics housing 104. By using a combination of a thinner flange (or a thinner access door 132) and indented portion 134, the access door 132 and the electronics housing 104 may be approximately flush with one another, providing a near seamless transition between the two components and enhancing the overall aesthetics of the electronics housing 104.

Figure 6:
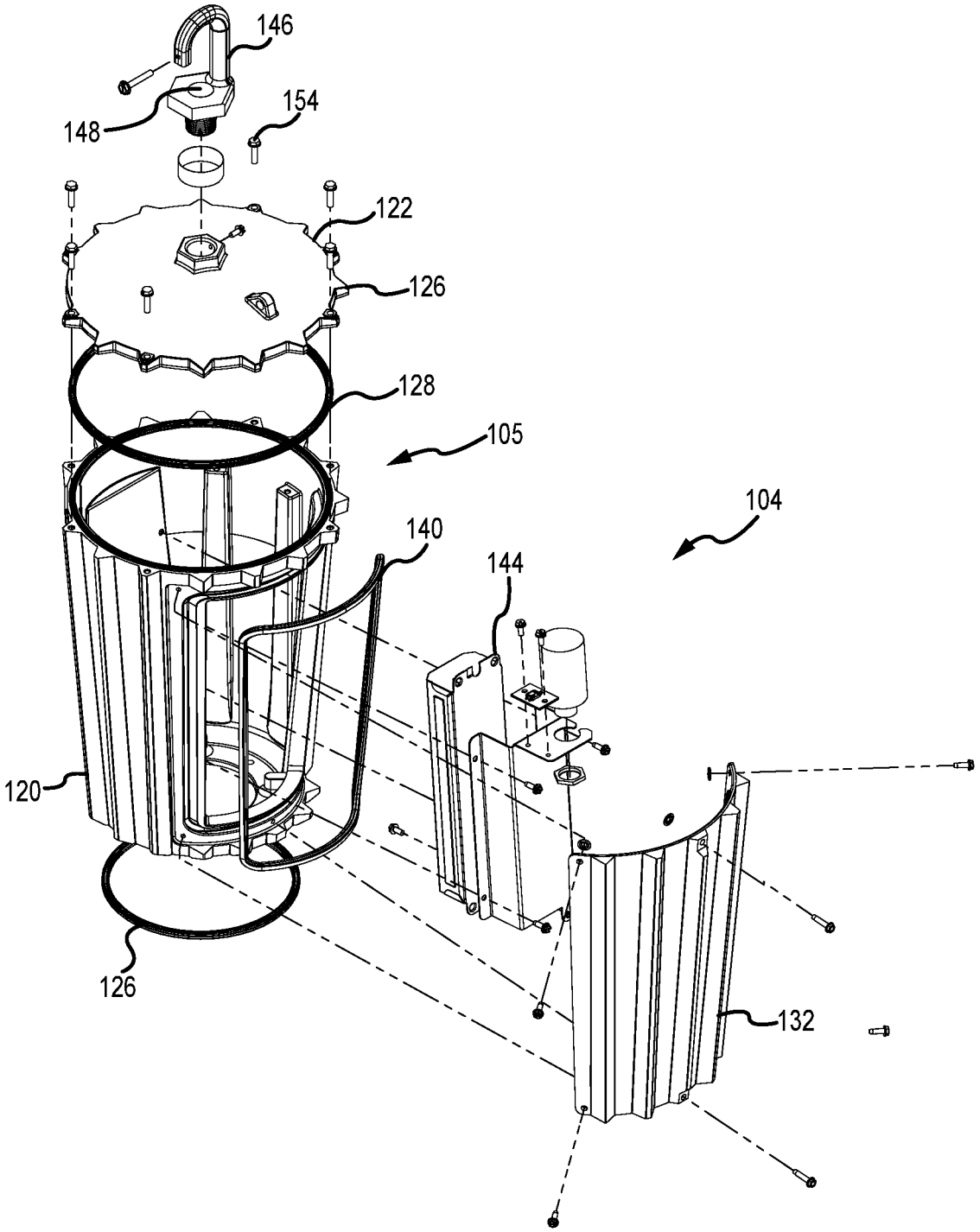
FIG. 6 is an exploded view of the electronics housing of the light fixture of FIG. 1.

FIG. 6 depicts an exploded view of electronics housing 104. Here, electrical components, such as a driver 144 are provided and fit within an interior of the electronics housing 104 formed by the body 105, the top cover 122, and the back housing 106. In embodiments with only one access door 132 and/or aperture 130, the electrical components may be oriented within the electronics housing 104 in a manner that aligns the component(s) that are mostly likely to need servicing and/or replacement with the aperture 130.

Gaskets may be used to seal components of the light fixture 100 and to create watertight seal(s) therebetween. For example, gaskets 128 may be positioned between the top cover 122 and the body 105 and/or between the back housing 106 and body 105 to seal the top and/or bottom of the electronics housing 104. In the illustrated embodiment, one or more O-rings or similar sealing mechanisms are provided to seal the top and/or bottom of the electronics housing 104. A gasket 140 may also be positioned between the access door 132 and the body 105. Gasket 140 may be sized and shaped to seal an entire peripheral interface between the access door 132 and the body 105, oftentimes having a shape that matches that of the aperture 130. For example, in the illustrated embodiment, the gasket 140 may have a generally trapezoidal shape matching the trapezoidal shape of the aperture 130 and access door 132. In embodiments having a flanged access door 132 and/or an indented portion 134, the gasket 140 may be positioned between the flange (or other edge of the access door 132) and the indented portion 134 such that the gasket 140 is compressed between the two components, thereby sealing the interior of the electronics housing 104 from the environment. In some embodiments, the gasket 140 may be removable from electronics housing 104 and the access door 132. In other embodiments, gasket 140 may be affixed to the body 105 or the access door 132. For example, the gasket 140 may be adhered to a surface of one of the components. In other embodiments, the gasket 140 may be partially inserted within a groove formed in the sidewall(s) 120 of the body 105 or the access door 132 such that a portion of the gasket 140 is positioned and/or secured within the groove with the remaining portion of the gasket 140 extending beyond the surface of the body 105 or the access door 132. By securing the gasket 140 to the body 105 or the access door 132, it is easier to align and secure the gasket 140 between the body 105 and the access door 132. Additionally, it is less likely that the gasket 140 will be damaged or misplaced.

In some embodiments, the access door 132 may be hingedly attached to the body 105 of the electronics housing 104, while in other embodiments the access door 132 is attached so as to be completely removable from the electronics housing 104 so as to permit easy servicing of the electronics housed within. Moreover, such servicing can be done when the light fixture 100 is in situ without requiring removal or disturbance of any other part of the fixture 100. This is in contrast to prior art fixtures whereby the electronics housing had to be accessed from the top or bottom (as opposed to the side) and thus typically required an installed fixture to be taken down and often disassembled to permit such access for servicing and maintenance.

It will be appreciated that multiple access doors 132 and or apertures 130 may be provided in the body 105 of the electronics housing 104. The size, number, and position of access doors 132 and/or apertures 130 may be determined by the size and/or shape of the body 105, as well as based on the orientation and relative positioning of electrical components within the electronics housing 104. For example, the apertures 130 and access doors 132 may be positioned proximate to components that are mostly likely to need service or replacement. This allows a technician to have direct access to a particular component or set of components by removing the corresponding access door(s) 132.

In the illustrated embodiment, a hook 146 is provided on the top cover 122 of the electronics housing 104. Hook 146 enables the light fixture 100 to be suspended from a ceiling using cables, chains, or other coupling mechanisms. In some embodiments, rather than having a hook 146, the light fixture 100 may be installed differently. For example, the light fixture 100 may include one or more brackets or mounting mechanisms that are coupled with the top cover 122 and/or the one or more sidewalls 120.

Figure 11:
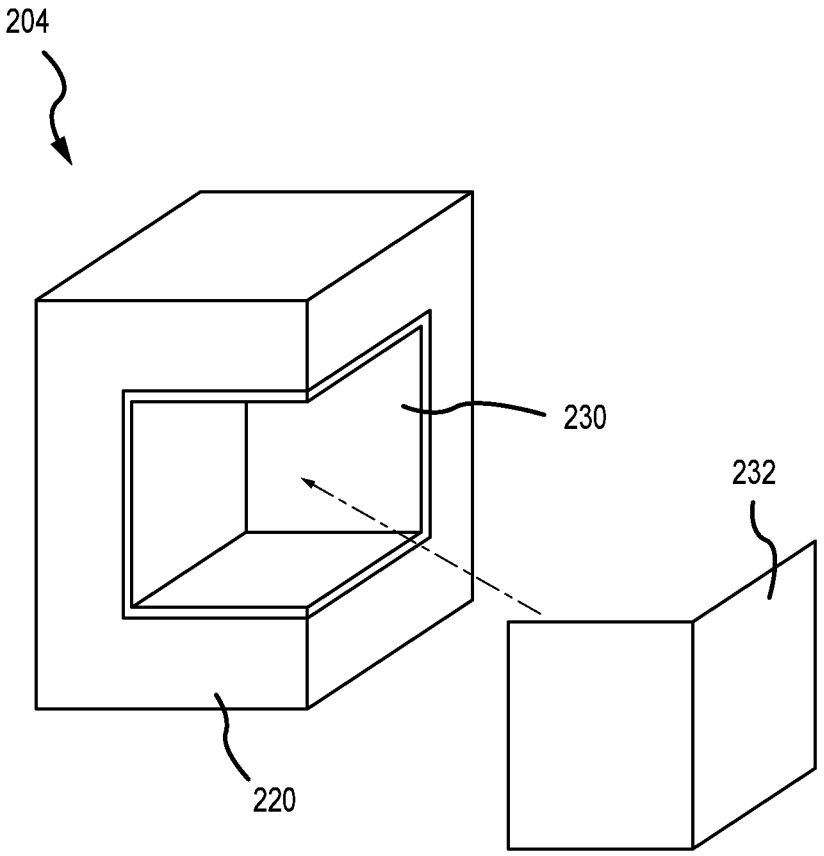
FIG. 11 depicts an alternative embodiment of an electronics housing of a light fixture according to embodiments.

FIG. 11 depicts another embodiment of an electronics housing 204 of a light fixture. Electronics housing 204 may be similar to electronics housing 104 and may be configured to couple with a light fixture and/or mounting element and may be configured to store any number of electrical components. Here, electronics housing 204 is generally rectangular and is formed from four sidewalls 220. An aperture 230 is defined in two adjacent sidewalls 220 such that the aperture 230 extends into multiple sidewalls 220. An access door 232 is coupled with the electronics housing 204 such that the access door 232 covers the entirety of the aperture 230. For example, the access door 232 may have a generally L-shaped cross-section such that the access door 232 may wrap around multiple sidewalls 220 of the electronics housing 204 to seal the aperture 230. Such a design may provide access to a greater number of components within the electronics housing 104. While shown here with aperture 230 extending into two sidewalls 220, it will be appreciated that aperture 230 (and corresponding access door 232) may extend into any number of sidewalls 220 that allows the access door 232 to be easily removed from the electronics housing 204. For example, aperture 230 may extend into three of the four sidewalls 220, while the access door 232 may have three sides such that the access door 232 has a generally U-shaped cross-section that allows the access door 232 to be slid onto the electronics housing 204 to seal the aperture.

Figure 12:
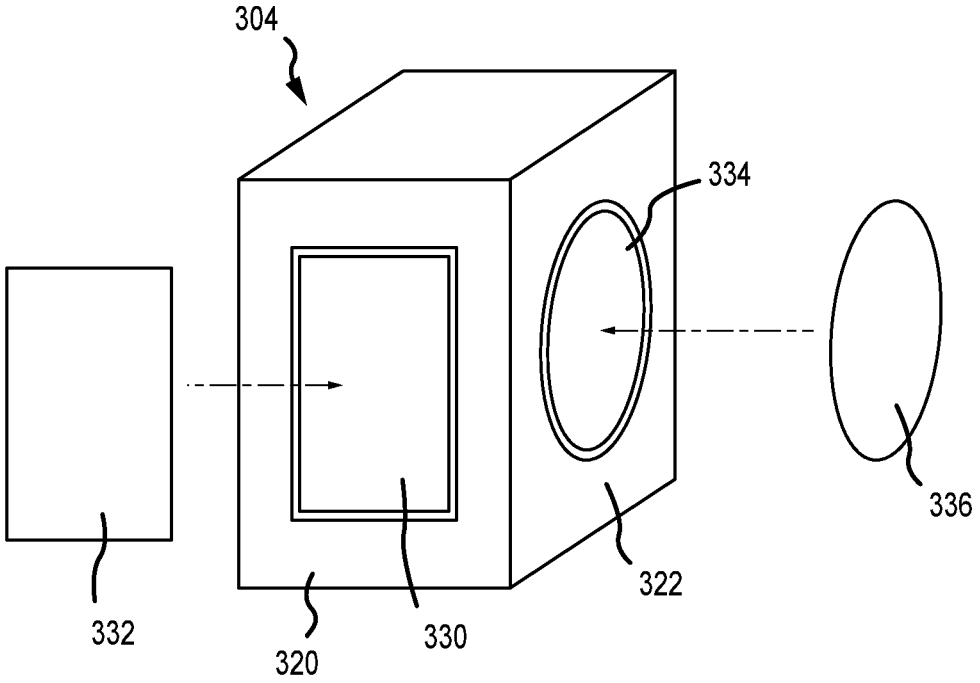
FIG. 12 depicts an alternative embodiment of an electronics housing of a light fixture according to embodiments.

FIG. 12 depicts another embodiment of an electronics housing 304 of a light fixture. Electronics housing 304 may be similar to electronics housing 104 and may be configured to couple with a light fixture and/or mounting element and may be configured to store any number of electrical components. Here, electronics housing 304 is generally rectangular and is formed from four sidewalls. Electronics housing 304 defines multiple apertures. For example, a first aperture 330 is positioned on a first sidewall 320 and a second aperture 334 is defined in a second sidewall 322. A corresponding access door may be provided for each aperture. For example, a first access door 332 may be provided that covers the first aperture 330, while a second access door 336 may be provided that covers the second aperture 334. In the illustrated embodiment, the first aperture 330 and the first access door 332 have a generally rectangular shape, while the second aperture 334 and the second access door 336 have a generally circular shape. It will be appreciated that in some embodiments, each of the apertures (and corresponding access door) may be the same size and/or shape while in other embodiments each aperture may be a different size and/or shape. While shown here with the apertures being centered on a respective sidewall of the electronics housing 304, it will be appreciated that in some embodiments the apertures may be positioned with respect to the sidewall(s) to provide optimal access to particular electrical components stored therein. Additionally, any number of apertures and access doors may be used on a particular housing. Some embodiments may include multiple apertures formed on a single sidewall.

The foregoing is provided for purposes of illustrating, explaining, and describing various embodiments. Having described these embodiments, it will be recognized by those of skill in the art that various modifications, alternative constructions, and equivalents may be used without departing from the spirit of what is disclosed. Different arrangements of the components depicted in the drawings or described above, as well as additional components and steps not shown or described, are possible. Certain features and subcombinations of features disclosed herein are useful and may be employed without reference to other features and subcombinations. Additionally, a number of well-known processes and elements have not been described in order to avoid unnecessarily obscuring the embodiments. Embodiments have been described for illustrative and not restrictive purposes, and alternative embodiments will become apparent to readers of this patent. Accordingly, embodiments are not limited to those described above or depicted in the drawings, and various modifications can be made without departing from the scope of the claims below. Embodiments covered by this patent are defined by the claims below, and not by the brief summary and the detailed description.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

What is claimed is:

1. A light fixture comprising:

a light engine comprising at least one light emitting diode (LED), the light engine comprising a front surface and a rear surface;

an electronics housing configured to house a plurality of electronic components, the electronics housing being coupled at a first end with the rear surface of the light engine, the electronics housing further comprising a second end and at least one side wall extending between the first end and the second end, wherein the at least one side wall defines an aperture though which at least some of the plurality of electronic components are accessible; and a cover that is coupled with the at least one side wall, the cover being sized and shaped to cover the aperture, wherein the at least one sidewall and the cover comprise heat dissipation fins, wherein the heat dissipation fins of the at least one sidewall and the cover are aligned when the cover is positioned over the aperture.

2. The light fixture of claim 1, further comprising:

a gasket positioned between edges of the cover and the electronics housing, the gasket being configured to seal the electronics housing when the cover is positioned over the aperture.

3. The light fixture of claim 1, wherein:

the cover is detachably coupled with the electronics housing.

4. The light fixture of claim 2, wherein:

the gasket has a shape that generally matches a shape of an outer periphery of the aperture and defines its own central aperture.

5. The light fixture of claim 4, wherein:

the gasket is permanently coupled with the cover.

6. The light fixture of claim 4, wherein:

the at least one sidewall or the cover defines a groove that is configured to receive a portion of the gasket.

7. The light fixture of claim 1, wherein:

the cover is secured to the electronics housing using one or more fasteners.

8. The light fixture of claim 1, wherein:

the cover has a cross-sectional profile that substantially matches at least a portion of a cross-sectional profile of the at least one side wall such that, when the cover is coupled with the at least one side wall, the cover and the at least one side wall form a generally seamless surface.

9. The light fixture of claim 1, wherein:

the electronics housing comprises an indented portion that forms an outer periphery of the aperture, the indented portion being configured to receive an outer edge of the cover.

10. A light fixture comprising:

a light engine comprising at least one light emitting diode (LED), the light engine comprising a front surface and a rear surface;

an electronics housing configured to house a plurality of electronic components, the electronics housing being coupled at a first end with the rear surface of the light engine, the electronics housing further comprising a second end and a sidewall having a generally circular cross-section, the sidewall extending between the first end and the second end, wherein the sidewall defines an aperture though which at least some of the plurality of electronic components are accessible;

a cover that is detachably coupled with the sidewall, the cover being sized and shaped to cover the aperture, wherein the sidewall and the cover comprise heat dissipation fins, wherein the heat dissipation fins of the sidewall and the cover are aligned when the cover is positioned over the aperture;

a gasket positioned between edges of the cover and the electronics housing, the gasket being configured to seal the electronics housing when the cover is detachably coupled with the sidewall over the aperture; and a plurality of fasteners configured to secure the cover to the electronics housing.

11. The light fixture of claim 10, wherein:

the sidewall has a conical frustum shape.

12. The light fixture of claim 10, wherein:

at least one of the plurality of fasteners is positioned in alignment with a central axis of the cover at a top edge or a bottom edge of the cover.

13. The light fixture of claim 10, wherein:

the gasket has a shape that generally matches a shape of an outer periphery of the aperture and defines a central aperture that provides access to the aperture when the gasket is coupled with the sidewall.

14. The light fixture of claim 10, wherein:

the aperture and the cover are each generally trapezoidal in shape.

15. The light fixture of claim 10, wherein:

the cover has a cross sectional shape having a curvature that matches a curvature of the generally circular cross-section of the sidewall.

16. The light fixture of claim 10, wherein:

the electronics housing comprises an indented portion that forms an outer periphery of the aperture, the indented portion being configured to receive an outer edge of the cover.

17. The light fixture of claim 10, wherein:

the gasket is permanently coupled with the cover.

18. The light fixture of claim 10, wherein:

the sidewall or the cover defines a groove that is configured to receive a portion of the gasket.

* * * * *